US006612503B2

(12) United States Patent
Hirota et al.

(10) Patent No.: US 6,612,503 B2
(45) Date of Patent: Sep. 2, 2003

(54) EXPANSION VALVE

(75) Inventors: Hisatoshi Hirota, Hachioji (JP); Takeshi Kaneko, Hachioji (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 10/263,915

(22) Filed: Oct. 3, 2002

(65) Prior Publication Data

US 2003/0066303 A1 Apr. 10, 2003

(30) Foreign Application Priority Data

Oct. 10, 2001 (JP) ..... 2001-312450

(51) Int. Cl.[7] ..... F25B 41/04
(52) U.S. Cl. ..... 236/92 B; 62/225; 251/337
(58) Field of Search ..... 62/225; 236/92 B; 251/337

(56) References Cited

U.S. PATENT DOCUMENTS 3,667,247 A 6/1972 Proctor ..... 62/217
5,068,503 A 11/1991 Sladky ..... 200/83 L
6,105,379 A * 8/2000 Alsenz et al. ..... 62/225

FOREIGN PATENT DOCUMENTS

| | | |
|---|---|---|
| EP | 0 350 612 A2 | 6/1989 |
| EP | 1 055 888 A2 | 11/2000 |
| JP | 11325661 | 11/1999 |
| JP | 2001133081 | 5/2001 |

* cited by examiner

*Primary Examiner*—William E. Tapolcai
(74) *Attorney, Agent, or Firm*—Patterson, Thuente, Skaar & Christensen, L.L.C.

(57) ABSTRACT

The object of the present Invention is to provide an expansion valve including a pressure sensor which enables reduction of parts cost. A pressure sensor is screwed into an opening of a body block, which communicates with a space accommodating a valve element and a compression coil spring for urging the valve element toward a valve seat. A set value for an expansion valve is adjusted by changing the amount of screwing of the pressure sensor to thereby change the load of the compression coil spring. An adjusting screw for adjusting the set value for the expansion valve can be dispensed with, which makes it possible to reduce the manufacturing costs of the expansion valve.

2 Claims, 3 Drawing Sheets

EXPANSION VALVE

BACKGROUND OF THE INVENITON

1. Field of the Invention

This invention relates to an expansion valve that adiabatically expands high-pressure refrigerant introduced therein to deliver the same to an evaporator, and includes a pressure sensor for sensing the pressure of the high-pressure refrigerant.

2. Description of the Related Art

Conventionally, a box-shaped expansion valve is known which has a valve portion for adiabatically expanding high-pressure refrigerant introduced therein to deliver the same to an evaporator, and a refrigerant passage for allowing refrigerant from the evaporator to pass therethrough, formed in the same body block, and includes a power element for sensing the temperature and pressure of the refrigerant at an outlet port of the evaporator. The expansion valve of this type is generally configured such that a valve element of the valve portion is urged by the power element for sensing the temperature and pressure of refrigerant at the outlet port of the evaporator to thereby control a valve travel of the valve.

Further, a refrigeration cycle has a pressure switch or a pressure sensor arranged therein, for detecting the pressure of refrigerant with a view to performing optimum cooling and heating operations. The above pressure switch or the pressure sensor has generally been attached to a refrigerant piping by way of a joint. Recently, however, a plurality of components are being integrally modularized to simplify the whole construction of the refrigeration cycle. This results in limited locations in the refrigeration cycle where the pressure switch or the pressure sensor can be freely attached. To cope with this inconvenience, it is now a practice to mount the pressure switch or the pressure sensor integrally with a portion of the expansion valve where the high pressure is introduced, for detection of the pressure of condensed liquid refrigerant, instead of attaching the pressure switch or the pressure sensor to a refrigerant piping.

As shown in FIG. 3, in the conventional expansion valve provided with the pressure sensor, the valve element 8 for controlling the flow rate of refrigerant is urged in a valve-closing direction by a compression coil spring 9 which is arranged within an opening 2*a* formed in the body block 2 such that the opening 2*a* has one end open to the outside air. Further, the compression coil spring 9 has a fixed end thereof received by an adjusting screw 10 screwed into a thread 2*b* formed in an inner wall of the opening 2*a*. A set value at which the valve element 8 of the expansion valve starts to open is adjusted by adjusting the amount of screwing of the adjusting screw 10 to change the urging force of the compression coil spring 9.

Further, the pressure sensor 22 is fitted at an open end-side portion of the opening 2*a*, for detecting the pressure of refrigerant within a high-pressure refrigerant passage. Mounted between the pressure sensor 22 and the opening 2*a* is a sealing O ring 22*e* for preventing leakage of refrigerant from the opening 2*a*.

As described above, the conventional expansion valve is constructed such that the adjusting screw 10 and the pressure sensor 22 are sequentially mounted in the opening 2*a*. Therefore, the assembly work of the valve is troublesome and parts cost cannot be reduced.

SUMMARY OF THE INVENTION

An object of the invention is to provide an expansion valve including a pressure sensor which enables reduction of parts cost.

To attain the above object, there is provided an expansion valve that has a first passage for adiabatically expanding high-pressure refrigerant introduced therein to deliver the refrigerant to an evaporator, and a second passage through which refrigerant from the evaporator passes, formed in the same body block, characterized by comprising a valve element arranged in a manner opposed to a valve seat formed in an intermediate portion of the first passage, a power element for urging the valve element in directions of moving to and moving away from the valve seat according to a temperature and pressure of refrigerant in the low-pressure refrigerant passage, a compression coil spring for urging the valve element toward the valve seat, and a pressure sensor that is screwed into an opening of the body block, the opening being formed to communicate with a side of the first passage where the high-pressure refrigerant is introduced, such that the pressure sensor receives a fixed end of the compression coil spring on a side opposite to the valve element, for sensing pressure of the introduced high-pressure refrigerant, wherein the compression coil spring has load thereon adjusted by an amount of screwing of the pressure sensor.

The above and other objects, features and advantages of the present invention will become apparent from the following description when taken in conjunction with the accompanying drawings which illustrate preferred embodiments of the present invention by way of example.

DESCRIPTION OF THE PREFERED EMBODIMENTS

Hereinafter, an embodiment of the present invention will now be described in detail with reference to drawings.

Figure 1:
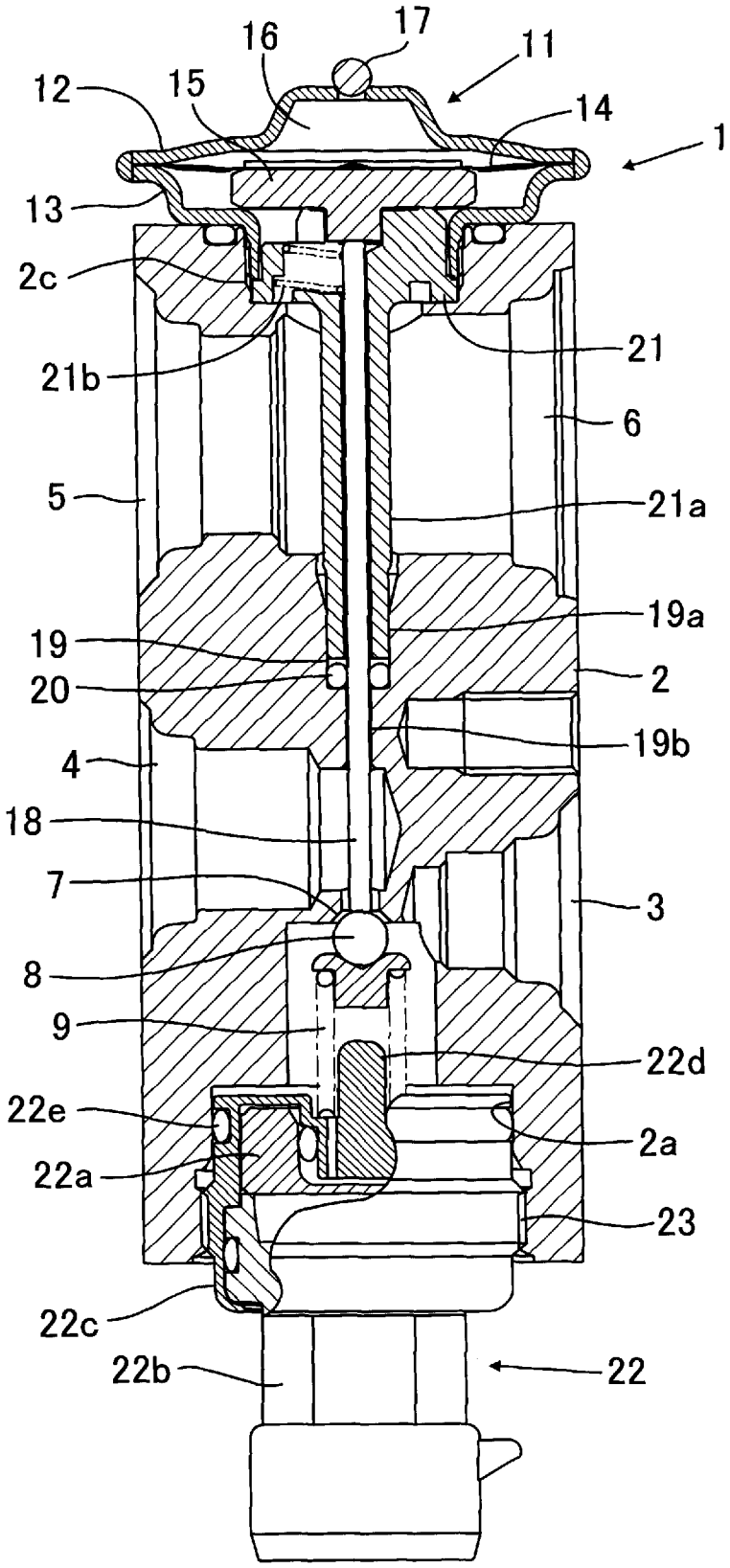
FIG. 1 is a side sectional view of an expansion valve according to an embodiment of the invention.
Figure 2:
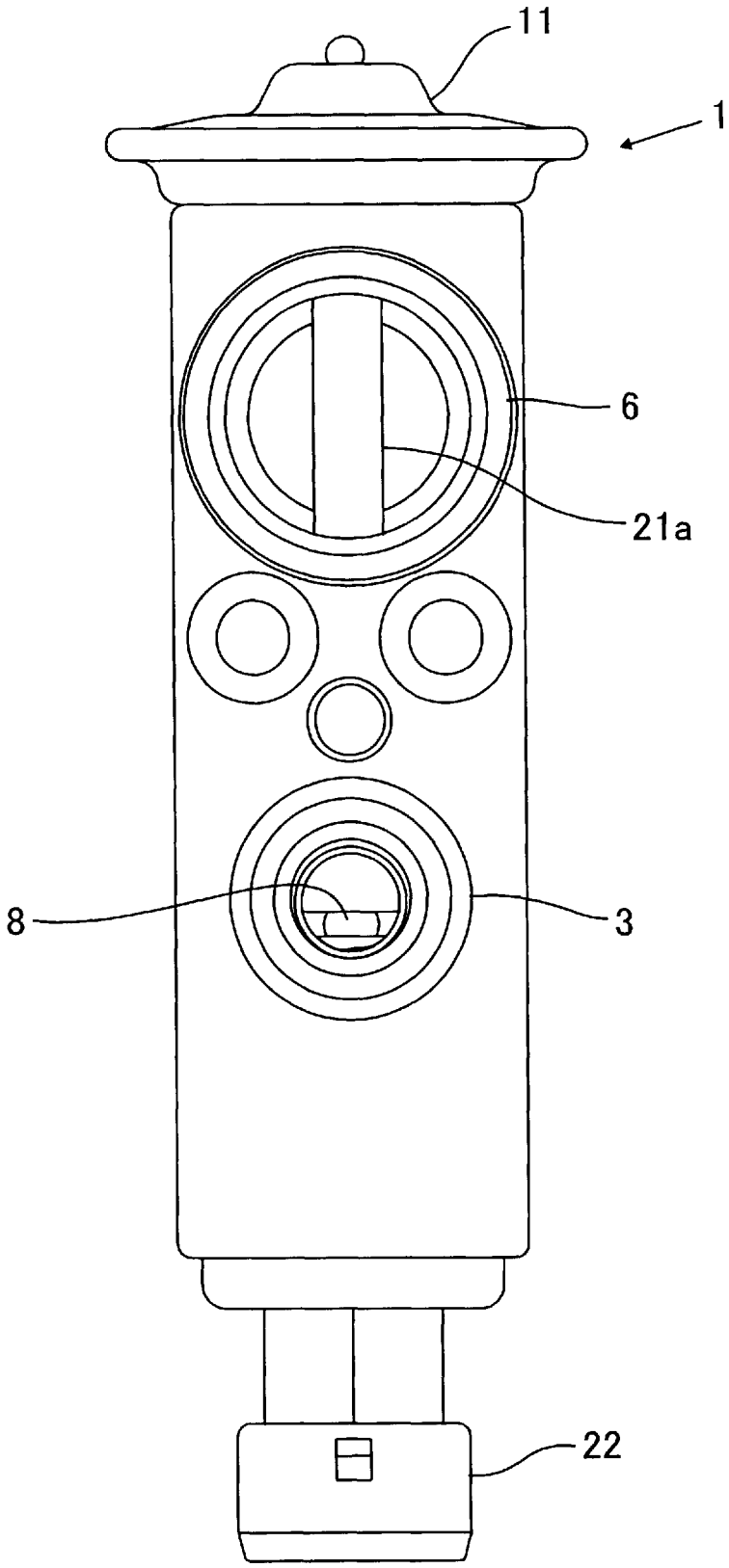
FIG. 2 is a front view of the FIG. 1 expansion valve.
Figure 3:
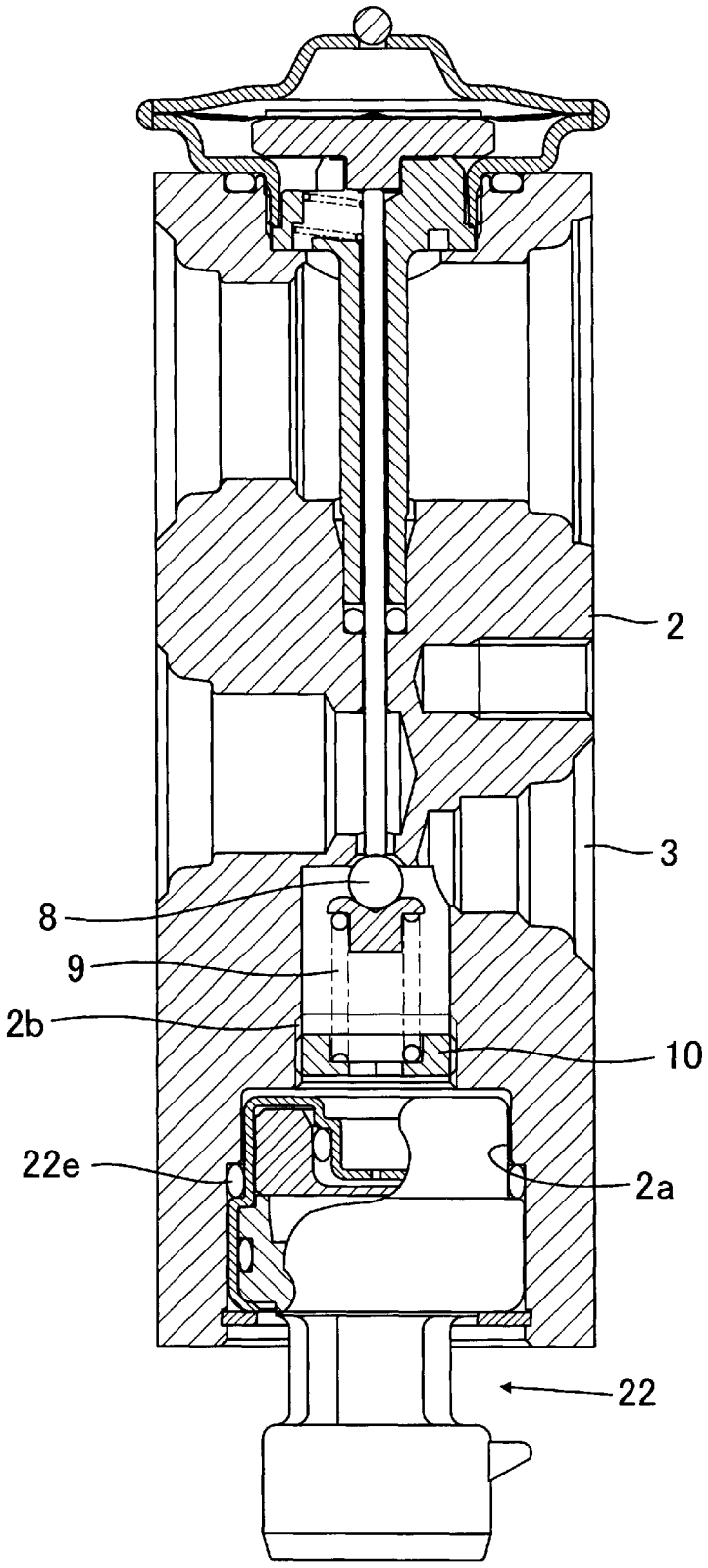
PRIOR ART FIG. 3
FIG. 3 is a side sectional view of a conventional expansion valve.

FIG. 1 is a side sectional view of an expansion valve according to an embodiment of the invention. FIG. 2 is a front view of the expansion valve. In the figures, reference numeral 1 designates an expansion valve for adiabatically expanding refrigerant while controlling the flow rate of the refrigerant delivered to an evaporator, not shown. The expansion valve 1 forms a refrigeration cycle together with a compressor, a condenser, a liquid receiver, the evaporator, and so forth. The refrigeration cycle is used as an automotive air conditioner, for instance.

The expansion valve 1 has a body block 2 having a side portion formed with a connection hole 3 to which is connected a high-pressure refrigerant piping to receive a high-temperature and high-pressure refrigerant from the liquid receiver through the piping, and a side portion formed with a connection hole 4 to which is connected a low-pressure refrigerant piping to supply a low-temperature and low-pressure refrigerant expanded by the expansion vale 1 to the evaporator. Further, it has a connection hole 5 to which is connected a refrigerant piping extending from an outlet port of the evaporator, and the connection hole 5 is communicated with a connection hole 6 connected to a refrigerant piping extending to the compressor.

In the expansion valve 1, a passage for adiabatically expanding high-pressure refrigerant introduced therein to deliver the same to the evaporator, and a passage for allowing the refrigerant from the evaporator to pass therethrough, are formed in the same body block 2 in parallel with each other. The body block 2 has a through hole 19 formed therein in a manner such that the through hole 19 extends perpendicularly to the above passages. Further, in a central portion of a passage communicating between the connection hole 3 and the connection hole 4, a valve seat 7 is formed in the shape of a constriction of the passage at a midpoint of the same in which the passage area is reduced, and a ball valve element 8 is arranged in a manner opposed to the valve seat 7 from the upstream side.

In the expansion valve 1 constructed as above, the narrowest portion of a gap between the valve element 8 and an inlet portion of the valve seat 7 forms a variable orifice for reducing the flow of the high-pressure liquid refrigerant, where the high-pressure liquid refrigerant is adiabatically expanded and flows into a downstream-side passage leading to the connection hole 4. Further, in an opening 2*a* extending downward from a passage on the side of the connection hole 3, there is arranged a compression coil spring 9 for urging the valve element 8 in a direction of seating the valve element 8 on the valve seat 7.

At an upper end of the body block 2, there is formed an opening 2*c* extending upward from the passage of the connection holes 5, 6, and a power element 11 is attached to the opening 2*c*. The power element 11 is comprised of an upper housing 12 and a lower housing 13, made of metal, a diaphragm 14 formed by a flexible thin metal plate and arranged in a manner dividing a space surrounded by the upper and lower housings, and a diaphragm-receiving board 15.

A space surrounded by the upper housing 12 and the diaphragm 14 forms a temperature-sensing chamber 16 which is filled with the same gas as the refrigerant, introduced from a hole in a top of the upper housing 12. The temperature-sensing chamber 16 is sealed by a metal ball 17.

The diaphragm-receiving board 15 arranged on an underside of the diaphragm 14 is in abutment with the upper end portion of a rod 18 such that displacement of the diaphragm 14 is transmitted to the valve element 8 via the rod 18. The rod 18 is inserted into the through hole 19 formed in the body block 2 and has the upper end portion thereof held by a holding member 21.

The through hole 19 has a large-diameter portion 19*a* at an upper portion thereof, and a small-diameter portion 19*b* at a lower portion thereof. The large-diameter portion 19*a* has an O ring 20 arranged therein for sealing a gap between the rod 18 and the through hole 19. The holding member 21 includes a hollow cylindrical portion 21*a* extending downward in a manner crossing the passage communicating between the connection holes 5, 6, and has a lower end portion thereof fitted in the large-diameter portion 19*a* of the through hole 19. As a result, the hollow cylindrical portion 21*a* restricts the upward movement of the O ring 20 by an end surface of the lower end portion thereof, and the O ring 20 prevents bypass leakage of the refrigerant from the high-pressure side to the low-pressure side, via the through hole 19.

Further, the holding member 21 contains a spring 21*b* for giving a lateral load to the rod 18. When periodical pressure fluctuation occurs in the refrigerant on the high-pressure side, the spring 21*b* controls the movement of the rod 18 so as to inhibit occurrence of longitudinal vibration of the rod 18.

The opening 2*a* arranged in a lower portion of the body block 2 has a pressure sensor 22 fitted therein. The pressure sensor 22 is comprised of a diaphragm member 22*a* forming a pressure-sensing portion, a connector member 22*b* for extracting a signal indicative of a pressure sensed by the pressure-sensing portion therefrom, and a holding member 22*c* for holding the diaphragm member 22*a* on the connector member 22*b*. The holding member 22*c* has a central portion integrally formed with a protrusion 22*d* for positioning the center of a fixed end of the compression coil spring 9. The holding member 22*c* is engaged with the body block 2 at a screw portion 23 formed in an outer periphery thereof, and at the same time has an O ring 22*e* arranged along the outer periphery for sealing a space containing the valve element 8 and the atmosphere from each other.

The expansion valve 1 described hereinabove is characterized in that the load of the compression coil spring 9 is adjusted by the pressure sensor 22 which is screwed into the opening 2*a* of the body block 2 from outside, instead of by the adjusting screw.

More specifically, the load of the compression coil spring 9 can be adjusted by adjusting the amount of screwing of the pressure sensor 22 screwed into the opening 2*a* at the screw portion 23.

In the expansion valve 1 constructed as above, when the temperature of the refrigerant returned from the evaporator into the connection hole 5 is lowered, the temperature in the temperature-sensing chamber 16 of the power element 11 is lowered, whereby the refrigerant gas in the temperature-sensing chamber 16 is condensed on an inner surface of the diaphragm 14. Consequently, pressure in the power element 11 is reduced to cause upward displacement of the diaphragm 14, so that the rod 18 is pushed by the compression coil spring 9 to be moved upward. Or, also when the pressure of the refrigerant returned from the evaporator to the connection hole 5 is increased, the diaphragm 14 is displaced upward, and the rod 18 is moved upward by being pushed by the compression coil spring 9. As a result, the valve element 8 is moved toward the valve seat 7, whereby the passage area of the high-pressure liquid refrigerant is reduced to decrease the flow rate of refrigerant sent into the evaporator.

On the other hand, when the temperature of the refrigerant gas returned from the evaporator rises, the pressure in the temperature-sensing chamber 16 of the power element 11 is increased, whereby the rod 18 is pushed downward against the urging force of the compression coil spring 9. Or, also when the pressure of the refrigerant returned from the evaporator to the connection hole 5 is decreased, the diaphragm 14 is displaced downward, and the rod 18 is moved downward against the urging force of the compression coil spring 9. Therefore, the valve element 8 is moved away from the valve seat 7, and the passage area of the high-pressure refrigerant is increased to increase the flow rate of the refrigerant sent into the evaporator.

As described heretofore, the expansion valve according to the invention is configured such that a pressure sensor is screwed into an opening communicating with a space into which high-pressure refrigerant of the expansion valve is introduced. This makes it possible to facilitate the assembly work of the pressure sensor.

Further, since the pressure sensor doubles as an adjusting screw used in the conventional expansion valve, it is possible to dispense with the adjusting screw, which enables reduction of parts cost.

Further, since the adjusting screw can be dispensed with, the length of a body block of the valve can be reduced, whereby the accuracy of cutting the valve in the longitudinal direction can be enhanced.

The foregoing is considered as illustrative only of the principles of the present invention. Further, since numerous modifications and changes will ready occur to those skilled in the art, it is not desired to limit the invention to the exact construction and applications shown and described, and accordingly, all suitable modification and equivalents may be regarded as falling within the scope of the invention in the appended claims and their equivalents.

What is claimed is:

1. An expansion valve that has a first passage for adiabatically expanding high-pressure refrigerant introduced therein to deliver the refrigerant to an evaporator, and a second passage through which refrigerant from the evaporator passes, formed in the same body block, characterized by comprising:

a valve element arranged in a manner opposed to a valve seat formed in an intermediate portion of the first passage;

a power element for urging the valve element in directions of moving to and moving away from the valve seat according to a temperature and pressure of refrigerant in the second passage;

a compression coil spring for urging the valve element toward the valve seat; and a pressure sensor that is screwed into an opening of the body block, the opening being formed to communicate with a side of the first passage where the high-pressure refrigerant is introduced, such that the pressure sensor receives a fixed end of the compression coil spring on a side opposite to the valve element, for sensing pressure of the introduced high-pressure refrigerant, wherein the compression coil spring has load thereon adjusted by an amount of screwing of the pressure sensor.

2. The expansion valve according to claim 1, wherein the pressure sensor has a protrusion for positioning a center of the compression coil spring, at a portion for receiving the fixed end of the compression coil spring.

* * * * *